US007699674B1

(12) United States Patent
Wald et al.

(10) Patent No.: US 7,699,674 B1
(45) Date of Patent: Apr. 20, 2010

(54) ACTUATOR FOR A MARINE STEERING SYSTEM

(75) Inventors: Benjamin C. Wald, Perkins, OK (US); Jason K. Angolano, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 12/194,676

(22) Filed: Aug. 20, 2008

Related U.S. Application Data

(63) Continuation-in-part of application No. 11/899,304, filed on Sep. 5, 2007, now abandoned.

(51) Int. Cl.
*B63H 5/125* (2006.01)

(52) U.S. Cl. ..... 440/58; 440/61 S

(58) Field of Classification Search ..... 114/144 R; 440/58–60, 61 S, 61 A, 61 C, 63; 91/418, 91/459

See application file for complete search history.

(56) References Cited

U.S. PATENT DOCUMENTS

| | | | | |
|---|---|---|---|---|
| 3,645,296 | A | 2/1972 | Adams | |
| 3,712,582 | A | 1/1973 | Moesta | |
| 4,200,030 | A | 4/1980 | Elser | |
| 4,593,780 | A * | 6/1986 | Saito | 180/444 |
| 4,841,790 | A | 6/1989 | Williston et al. | |
| 5,129,273 | A * | 7/1992 | Fukui et al. | 74/89.35 |
| 5,471,907 | A * | 12/1995 | Kobelt | 91/368 |
| 5,603,279 | A * | 2/1997 | Hundertmark et al. | 114/150 |
| 5,947,155 | A | 9/1999 | Miki et al. | |
| 6,065,451 | A | 5/2000 | Lebrun | |
| 6,234,853 | B1 | 5/2001 | Lanyi et al. | |
| 6,354,184 | B1 | 3/2002 | Hansen et al. | |
| 6,755,703 | B1 * | 6/2004 | Erickson | 440/75 |
| RE39,032 | E | 3/2006 | Gonring et al. | |
| 7,131,385 | B1 | 11/2006 | Ehlers et al. | |
| 7,168,360 | B2 | 1/2007 | Massaccesi et al. | |
| 7,284,634 | B2 * | 10/2007 | Tatewaki et al. | 180/444 |
| 7,311,572 | B2 * | 12/2007 | Yamashita et al. | 440/63 |
| 2003/0150367 | A1 * | 8/2003 | Hundertmark | 114/150 |
| 2005/0170712 | A1 * | 8/2005 | Okuyama | 440/59 |
| 2007/0137327 | A1 | 6/2007 | Heitzer | |
| 2008/0113571 | A1 * | 5/2008 | Zelm et al. | 440/53 |

* cited by examiner

*Primary Examiner*—Stephen Avila
(74) *Attorney, Agent, or Firm*—William D. Lanyi

(57) ABSTRACT

A steering mechanism connects the shaft of an actuator with a piston rod of a hydraulic cylinder and provides a spool valve in which the spool valve housing is attached to the hydraulic cylinder and the shaft of the actuator extends through a cylindrical opening in a spool of the spool valve. The connector is connectable to a steering arm of a marine propulsion device and the spool valve housing is connectable to a transom of a marine vessel.

20 Claims, 4 Drawing Sheets

ACTUATOR FOR A MARINE STEERING SYSTEM

CROSS REFERENCE TO RELATED APPLICATIONS

This patent application is a continuation-in-part of U.S. patent application Ser. No. 11/899,304 (M10156) filed on Sep. 5, 2007, now abandoned.

BACKGROUND OF THE INVENTION

1. Field of the Invention

The present invention is generally related to a marine steering system and, more particularly, to an actuator which combines a linear actuator and a spool valve in a compact structure for use in a steering system of a marine propulsion device.

2. Description of the Related Art

Those skilled in the art of marine propulsion systems are aware of many different steering devices that can be used to cause the rotation of a marine propulsion device about a generally vertical steering axis. Typically, a cable system is incorporated in the steering system and connects a steering arm of a marine propulsion device to a manually controllable steering mechanism, such as a steering wheel. Other types of steering systems incorporate hydraulically assisted components which use pressurized hydraulic fluid to provide force in order to assist the operator of a marine vessel in accomplishing steering maneuvers. Some hydraulic steering systems use a pump mechanically attached to a steering wheel and a hydraulic actuator attached to the marine propulsion device. Other types of hydraulic steering systems use a mechanically or electrically driven hydraulic pump to provide pressurized hydraulic fluid that is then ported, by suitable valves, to actuators that effect the steering maneuvers.

In certain marine steering systems, two or more marine propulsion devices can be individually rotated about their respective steering axes independently so that complicated maneuvers can be accomplished by selectively directing the propeller thrusts of the marine propulsion devices in selected directions while also controlling the forward and reverse rotation of the propellers in order to provide suitable thrust vectors that allow the marine vessel to be maneuvered. These types of systems typically use a joystick associated with a microprocessor to interpret commands from the operator of a marine vessel and calculate the necessary individual thrust vectors necessary to accomplish those commanded maneuvers.

U.S. Pat. No. 3,645,296, which issued to Adams on Feb. 29, 1972, describes a power assisted steering system. A power assisted rack and pinion steering system includes a housing, relatively rotatable torque input and output shafts mounted for rotation in the housing, a pinion mounted for joint rotation on the torque output shaft, a rack engaging the pinion and a fluid valve assembly for controlling the flow of fluid to and from the opposite ends of a double-acting servomotor also connected to the rack for assisting in the movement thereof. The valve assembly comprises a circumferentially grooved spool valve connected to one of the shafts for axial movement, such movement occurring when the shafts are rotated relative to one another. Axial movement of the spool valve establishes fluid communication between a power fluid pump and the servomotor for powered movement of the servomotor and hence the rack.

U.S. Pat. No. 3,712,582, which issued to Moesta on Jan. 23, 1973, describes a fluid flow control valve and linear actuator therefore. A support housing having a cylindrical bore in which a complimentary cylindrical spool valve is carried and screw-threadedly engaged with the housing is described. The valve is rotated by a drive motor for linear movement of the valve in the bore. An inlet port and an outlet port open to the bore so that communication therebetween is accurately controlled by the linear positioning of the spool valve. A pulse drum structure is connected with and rotates with the spool valve and has sensor points thereon which, as the pulse drum rotates with the valve, pass by a sensing device which is thus enabled to sense linear change of position of the drum and hence its associated valve.

U.S. Pat. No. 4,200,030, which issued to Elser on Apr. 29, 1980, describes a servo steering gear. A power steering gear mechanism is disclosed having conventional elements such as a double acting cylinder in a housing, a piston with a gear rack geared to a gear sector, and threaded bore in the piston having a worm shaft, wherein a steering shaft operates a rotary valve spool with which it is integral, in rotation relative a fixed valve sleeve carried by the worm shaft and wherein a torque rod connects the worm shaft to the steering spindle and passes through the worm shaft.

U.S. Pat. No. 4,841,790, which issued to Williston et al. on Jun. 27, 1989, describes an electromechanical actuator. The actuator is particularly attractive for vehicle steering applications and includes a case having a cover part rigidly attached to a housing part and an output rod supported on the case for linear shiftable movement along a primary axis of the case. An electric motor is mounted on the housing part of the case with a shaft of the motor supporting in cantilever fashion a pinion in a gear chamber of the case between the housing and covered parts.

U.S. Pat. No. 5,947,155, which issued to Miki et al. on Sep. 7, 1999, describes a linear solenoid valve. The valve is composed of a pressure regulating section and an actuator section. In the pressure regulating section, a valve spool is slidably disposed and is biased in one direction by a single elastic member. The actuator section generates a thrust force and transmits that generated thrust force in an opposite direction to the pressure regulating section via a shaft.

U.S. Pat. No. 6,065,451, which issued to Lebrun on May 23, 2000, describes a bypass valve with a constant force-versus-position actuator. A control arrangement for a fuel system having a fuel pump for supplying fuel through a variable orifice flow metering valve to an engine main fuel control is described. The control portion controls the fuel pressure differential across an orifice of the metering valve. A head sensor includes a movable diaphragm, a bypass valve for diverting fuel from the fuel pump away from the metering valve, and a coupling between the diaphragm and the bypass valve whereby the bypass valve opens and closes in response to diaphragm motion.

U.S. Pat. No. 6,234,853, which issued to Lanyi et al. on May 22, 2001, discloses a simplified docking method and apparatus for a multiple engine marine vessel. The system is provided which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system of the invention uses two marine propulsion units to respond to an operator's command signal and allows the operator to select forward or reverse commands in combination with clockwise or counter-clockwise rotational commands either in combination with each other or alone.

U.S. Pat. No. 6,354,184, which issued to Hansen et al. on Mar. 12, 2002, describes a power machine with valve mount for valve assembly. A power machine or a skid steer loader that is driven by an engine and has a hydraulic pump, hydraulic fluid conduit, a hydraulic motor in fluid communication with a hydraulic fluid conduit and a valve that is operated or actuated by linear actuator such that the linear actuator is mounted directly on the valve block is described.

U.S. Reissued Pat. RE39,032, which issued to Gonring et al. on Mar. 21, 2006, discloses a multi-purpose control mechanism for a marine vessel. The mechanism allows the operator of a marine vessel to use the mechanism as both a standard throttle and gear selection device and, alternatively, as a multi-axes joystick command device. The control mechanism comprises a base portion and a level that is movable relative to the base portion along with a distal member that is attached to the lever for rotation about a central axis of the lever. A primary control signal is provided by the multi-purpose control mechanism when the marine vessel is operated in a first mode in which the control signal provides information relating to engine speed and gear selection. The mechanism can also operate in a second or docking mode and provide first, second and third secondary control signals relating to desired maneuvers of the marine vessel.

U.S. Pat. No. 7,131,385, which issued to Ehlers et al. on Nov. 7, 2006, discloses a method for braking a vessel with two marine propulsion devices. The method comprises steps that rotate two marine propulsion devices about their respective axes in order to increase the hydrodynamic resistance of the marine propulsion devices as they move through the water with the marine vessel. This increased resistance exerts a braking thrust on the marine vessel. Various techniques and procedures can be used to determine the absolute magnitudes of the angular magnitudes by which the marine propulsion devices are rotated.

U.S. Pat. No. 7,168,360, which issued to Massaccesi et al. on Jan. 30, 2007, describes a steering system actuator for a vehicle with at least three steered wheels. A linear actuator for vehicle powered steering systems with at least three steered wheels of a double-acting type that comprises a cylindrical body, closed and open ends, is disclosed. It also comprises a piston, accommodated inside the cylindrical body axially slidable between the ends, and a stem which is rigidly associated with the piston, coaxial to the cylindrical body, and protruding from at least one of the ends. A piston divides the cylindrical body into two chambers. Each chamber is provided with an inflow/outflow opening formed at the two opposite ends. At least one pair of one-way valves, provided in the piston with a respective inlet connected to a respective chamber and outlets mutually connected, each valve having a step slidably accommodated in the respective inlet with one end associated with a respective flow control element and the opposite end that protrudes externally from the piston, so as to open a respective valve.

U.S. patent application Ser. No. 11/602,532, which was filed by Heitzer on Nov. 21, 2006, describes a valve device for a hydraulic servo steering arrangement. It includes two valve elements which can be rotated from a neutral position relative to each other in order to thereby achieve the superimposition of an additional steering moment. The valve device further includes a linear actuator and a gear coupling the two valve elements to each other. The gear converts a linear stroke of the linear actuator into rotation. The gear includes a first cog wheel with teeth inclined in a first direction in relation to the actual direction of the cog wheel. The first cog wheel is coupled to the first valve element. The gear further includes a second cog wheel with teeth inclined in a second direction opposed to the first direction. The second cog wheel is axially displaceable by the linear actuator.

The patents described above are hereby expressly incorporated by reference in the description of the present invention.

It would be significantly beneficial if a compact device could be provided which provides a marine steering system with inherent mechanical feedback that coordinates the movement of a hydraulic actuator and a hydraulic valve under the control of the linear actuator which, in turn, is controlled by signals received from a microprocessor.

SUMMARY OF THE INVENTION

A steering mechanism, in a preferred embodiment of the present invention, comprises a spool valve housing, a spool supported in sliding relation within the spool valve housing, a steering cylinder attached to the spool valve housing, an actuator having a housing and a shaft, and a connector. The steering cylinder comprises a hydraulic cylinder and a piston rod extending from the hydraulic cylinder. The actuator is configured to selectively extend and retract the shaft relative to the housing in directions parallel to a central axis of the shaft. The steering cylinder, actuator, connector, and spool valve housing are connected together in a manner which causes the connector and the spool valve housing to move away from each other in synchrony with the piston rod being extended from the hydraulic cylinder and the shaft being extended from the housing of the actuator. The arrangement also causes the connector and the spool valve housing to move toward each other in synchrony with the piston rod when the piston rod is retracted into the hydraulic cylinder and the shaft is retracted into the housing of the actuator.

In a preferred embodiment of the present invention, the shaft and the piston rod are attached to the connector and the housing is attached to the spool. The hydraulic cylinder can be attached to the spool valve housing with the shaft extending through a central cylindrical cavity of the spool. In a particularly preferred embodiment of the present invention, the actuator is a linear actuator which comprises an electric motor and a gear set. The shaft is attached to a gear of the gear set. The connector is connectable to a steering arm of a marine propulsion device in a particularly preferred embodiment of the present invention and the spool valve housing is connectable to a transom of a marine vessel.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
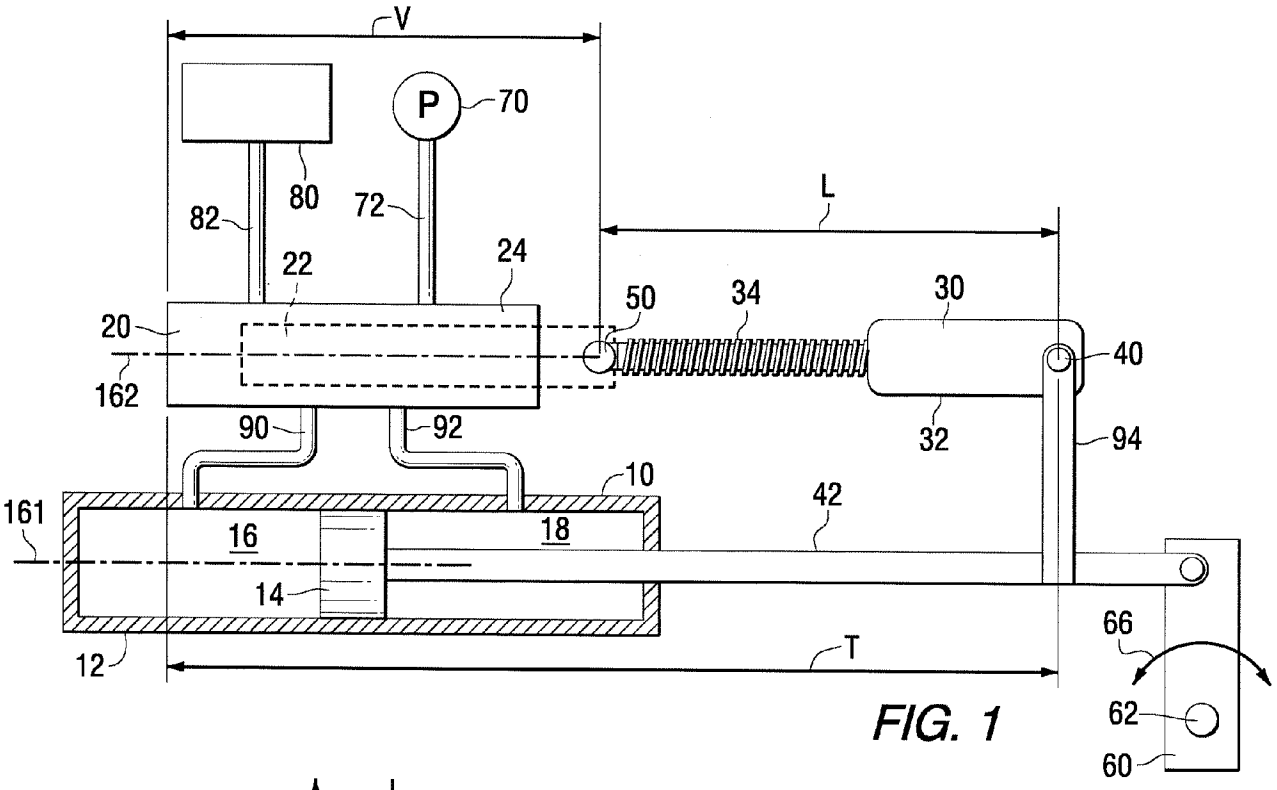
FIG. 1 is a schematic representation of a steering system made in accordance with a preferred embodiment of the present invention.

Throughout the description of the preferred embodiment of the present invention, like components will be identified by like reference numerals.

A preferred embodiment of the present invention is intended to provide a steering system for a marine vessel which is less expensive than alternative hydraulically assisted systems and which is operable even when an associated internal combustion engine is inoperative or when pressurized hydraulic fluid is unavailable to assist in steering maneuvers. The valve, is a preferred embodiment of the present invention, has an open center configuration which reduces the consumption of energy and the linear actuator will supply sufficient force to overcome the inherent flow forces created by the open center condition of the spool. A preferred embodiment of the present invention is also intended to provide redundancy with mechanical feedback that is inherent in the design of the actuator system. Certain embodiments of the present invention are intended for use in marine propulsion systems with a single marine propulsion device or with two or more marine propulsion devices that are each individually steerable about their respective steering axes. The ability to independently steer two or more marine propulsion devices allows significantly improved maneuverability to be accomplished.

FIG. 1 is a simplified representation of a marine steering system. A hydraulic actuator 10 comprises a cylinder 12 and a piston 14. The piston 14 is movable within the cylinder 12 in response to changes in differential pressure between chambers 16 and 18. A spool valve 20 is connected in fluid communication with the hydraulic actuator 10 and has a movable spool 22, which is represented by dashed lines in FIG. 1, that is disposed within a valve housing is 24. A linear actuator 30 comprises an electric motor 32 and a shaft 34. The linear actuator 30 is mechanically attached between the hydraulic actuator 10 and the spool 22 of the spool valve 20. More specifically, in a preferred embodiment, the electric motor 32 of the linear actuator is attached, at point 40, to the piston 14 of the hydraulic actuator. The connection is with a rod 42 attached to the piston 14. The shaft 34 of the linear actuator is attached at point 50 to the spool 22 of the spool valve 20. A steering arm 60 is attached to the piston rod 42 of the hydraulic actuator 10. More specifically, the steering arm 60 is attached to the rod 42 which, in turn, is attached to the piston 14. The steering arm 60 is rotatable about a steering axis 62 for rotation, as represented by arrow 66, with the marine propulsion device which will be described in greater detail below.

With continued reference to FIG. 1, a pump 70 provides pressurized fluid through conduit 72 to a port of the spool valve 20. A reservoir 80 contains hydraulic fluid that is used by the spool valve 20 and hydraulic actuator 10. Hydraulic fluid is returned to the reservoir 80 through conduit 82. The pump 70 obtains that hydraulic fluid from the reservoir and provides it, under pressure, to the spool valve 20 which directs the hydraulic fluid to flow into either chamber 16 or chamber 18 of the hydraulic actuator 10. Conduit 90 directs the flow of hydraulic fluid from the spool valve 20 to chamber 16 while conduit 92 directs hydraulic fluid under pressure from the spool valve 20 to chamber 18. This selective flow of pressurized fluid into chambers 16 or 18 causes the piston 14 and its attached rod 42 to move to the left or right in FIG. 1. This, in turn, exerts a force on the steering arm 60 which causes the steering arm and an attached marine propulsion device to rotate about the steering axis 62. The linear actuator 30 typically comprises a DC motor 32 which causes the threaded shaft 34 to rotate in either a clockwise or counterclockwise direction. This changes the effective length of dimension L.

With continued reference to FIG. 1, two other dimensions are identified. One dimension V is arbitrarily representative of the length between the end of the spool valve 20 and the connection point 50 between the shaft 34 and the spool 22. Dimension T is the total dimension between that same end of the spool valve 20 and the connection point 40 between the piston rod 42 and the linear actuator 30. As arbitrarily selected for purposes of this description, lengths V and L, added together, equal length T. If length L changes, length V must change because the attachments between the components define length T as a constant magnitude. Therefore, as the linear actuator 30 causes length L to increase, length V must decrease as a result of movement of the spool 22 relative to the housing 24 of the spool valve 20. Conversely, as length L decreases as a result of actuation by the linear actuator 30, the spool 20 will move toward the right relative to the housing 24 in order to increase the magnitude of dimension V. As will be described in greater detail below, this physical connection between the spool valve 20, the linear actuator 30, and the hydraulic actuator 10 provides a mechanical feedback loop that assists in the operation of the steering mechanism. As can be seen in FIG. 1, the arrangement also allows the linear actuator 30 to effect appropriate steering maneuvers even when the pump 70 is inoperative and no pressurized hydraulic fluid is available to assist in those steering maneuvers. This provides a fail safe characteristic. Furthermore, the arrangement shown in FIG. 1 provides a compact and efficient design.

Figure 2:
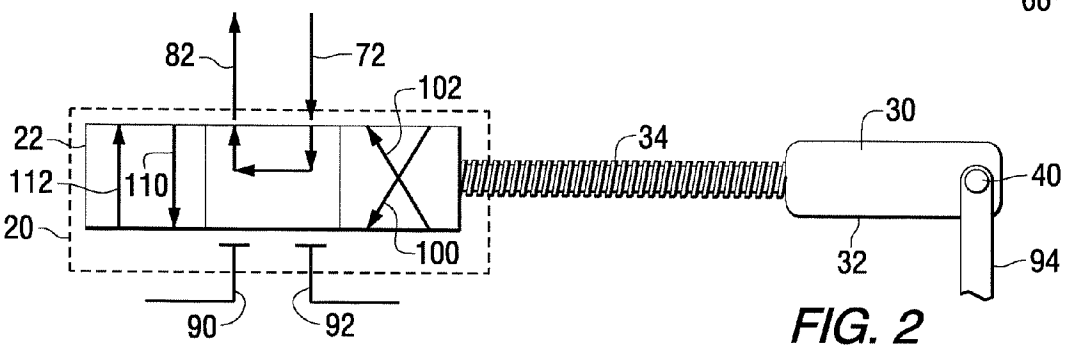
FIG. 2 is a symbolic representation of portions of the illustration in FIG. 1.

FIG. 2 is a schematic representation of the spool valve 20 showing the three stages that are achievable by movement of the spool 22 to the left or right in FIG. 2. Arrows 72 and 82 are analogous to the conduits 72 and 82 in FIG. 1. Pressurized hydraulic fluid is provided at arrow 72 and is returned to the reservoir 80 at arrow 82. When the spool 22 is moved toward the left in FIG. 2, pressurized hydraulic fluid passes, as represented by arrow 100, from the pressurized line 72 to conduit 90 and chamber 16. This moves the piston 14 toward the right in FIG. 1. Similarly, fluid from conduit 92 is ported to the reservoir at arrow 82 as represented by arrow 102 in the spool 22.

With continued reference to FIGS. 1 and 2, when the spool 22 is moved toward the right pressurized fluid at arrow 72 is ported to conduit 92 as represented by arrow 110 and pressurized fluid is ported from conduit 90 to arrow 82 in the reservoir 80 as represented by arrow 112. This causes chamber 18 to be pressurized which moves the piston 14 and its connected rod 42 toward the left. The central portion of the spool 22 recirculates pressurized fluid from the pump 70 back to the reservoir 80. Although the hydraulic actuator 10 and steering arm 60 are not shown in FIG. 2, it should be understood that the basic arrangement in FIG. 1 exists in conjunction with the spool valve 20 shown in FIG. 2. With reference to FIGS. 1 and 2, various conditions of the steering actuator will be described. When the linear actuator 30 is extended, to increase dimension L, the spool valve 20 connects pressure to conduit 90 by moving the spool 22 toward the left. This pressurizes chamber 16 and moves the piston 14 toward the right. As this occurs, dimension T increases. As dimension L of the linear actuator increases, dimension V decreases because the spool, initially, is moved toward the left in response to movement of the shaft 34 as it extends away from the motor 32. As this occurs, mechanical feedback is created.

The increased magnitude of dimension T is partially accommodated by the increasing magnitude of dimension L which, in turn, diminishes the need for a decrease in dimension V. Eventually, the system achieves a balanced condition and the spool 22 moves to its central position in which no hydraulic fluid flows through either conduit 90 or 92.

When the spool valve position is in neutral, conduit 72 is connected to conduit 82 and energy consumption is minimized to the pump causing a free flow of fluid to the tank with very little restriction. The inherent flow forces resulting is from the open center configuration of the spool valve create an instance where a considerable force is needed to displace the spool valve from the neutral position, in comparison to a solenoid valve or a servo valve. Conversely, when the linear actuator 30 retracts its shaft 34 to decrease dimension L, the spool 22 is moved toward the right relative to the housing 24 of the spool valve 20 as pressurized fluid flows from the spool valve 20 into conduit 92 and chamber 18. This, in turn, moves the piston 14 toward the left and decreases the magnitude of dimension T. The decrease in dimension T reduces the required increase in dimension V that would otherwise be associated with a decrease in dimension L. Eventually, the system reaches a balance in which the spool 22 is again centered within the housing 24 of the spool valve 20 and pressurized hydraulic fluid flows through neither conduit 90 or 92.

With continued reference to FIGS. 1 and 2, it can also be seen that if the pump 70 becomes inoperative, the linear actuator 20 can operate the steering arm 60. A mechanical force provided by the ball screw shaft 34 can be selected to be sufficient to cause hydraulic fluid to flow from the chambers, 16 or 18, through conduits 90 or 92, and the spool valve 20. Of course, the linear actuator 30 must be appropriately sized to provide sufficient force to move the piston 14 and its piston rod 42 in order to accomplish steering by rotating the steering arm 60 about the steering axis 62. However, this capability is well within the knowledge and know how of those skilled in the art of marine propulsion steering systems.

Figure 3:
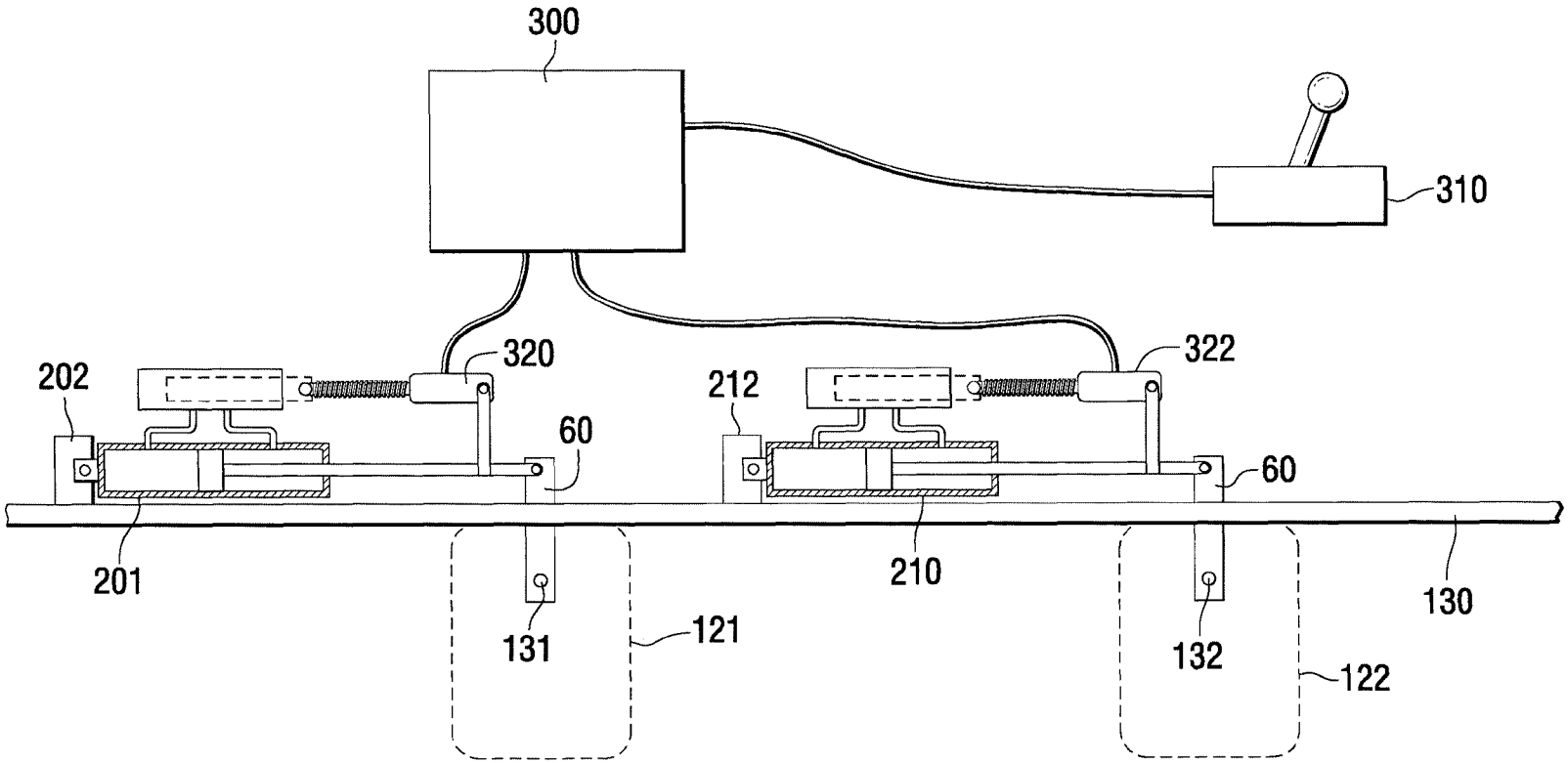
FIG. 3 shows two marine steering systems which are both made in to accordance with a preferred embodiment of the present invention and associated with two moving propulsion systems within a marine vessel.

FIG. 3 is a schematic representation of a marine vessel with two marine propulsion devices, 121 and 122. The marine propulsion devices are supported by a transom 130 of a marine vessel to rotate about their respective steering axes, 131 and 132. A first marine steering system 201 is attached to the marine vessel, such as represented by attachment 202. A second marine steering system 210 is attached by component 212. Although reduced in size for purposes of illustration, both marine steering systems, 201 and 210, are intended to be generally similar in structure and configuration as the steering system shown in FIG. 1.

A microprocessor 300 and a joystick 310 are provided. In the arrangement shown in FIG. 3, the microprocessor 300 receives signals from the joystick 310 and converts those signals into particular commands for the linear actuator 320 of the first system 201 and the linear actuator 322 of the second marine steering system 210. The steering arms 60 extend through the transom 130 of the marine vessel and allow the respective pistons of the hydraulic actuators to exert a rotational force to cause the steering arms 60, along with their respective marine propulsion devices, 121 or 122, to rotate about their respective steering axes, 131 and 132. The marine propulsion devices can be independently steered about their steering axes so that the microprocessor 300 can accomplish maneuvering commands received from the joystick 310.

With continued reference to FIGS. 1-3, it can be seen that a marine steering system made in accordance with a preferred embodiment of the present invention comprises a hydraulic actuator 10 which, in turn, comprises a cylinder 12 and piston 14. The piston 14 is attached to a piston rod 42. A spool valve 20 is connected in fluid communication with the hydraulic actuator 10 and has a movable spool 22 disposed within a valve housing 24. A linear actuator 30 comprises an electric motor 32 and a shaft 34, such as a ball screw. The linear actuator 30 is mechanically attached between the hydraulic actuator 10 and the spool valve 20. A steering arm 60 is attached to the hydraulic actuator 10 and a marine propulsion device, such as 121 or 122, is attached to the steering arm 60 and supported for rotation about a generally vertical steering axis 62. A preferred embodiment of the present invention can further comprise a microprocessor 300 connected in electrical communication with a linear actuator 30 and a joystick 310 connected in signal communication with a microprocessor 300. The piston 14 is mechanically connected through the linear actuator 30, through a connection with the piston rod 42 and linkage 94 at point 40. The shaft 34 of the linear actuator 30 is mechanically attached to a slidable spool 22 of the spool valve 20. Movement of the piston 14 relative to the cylinder 12 is coordinated with movement of the movable spool 22 relative to the valve housing 24 as a function of the linear actuator 30 being mechanically attached between the hydraulic actuator 10 and the spool valve 20. Movement of the piston 14 relative to the cylinder 12 is along a first axis 161 and movement of the movable spool 22 relative to the valve housing 24 is along a second axis 162. The first and second axes, 161 and 162, are generally parallel to each other as illustrated in FIG. 1. The first and second axes, 161 and 162, are also generally parallel to a central axis of the shaft 34 of the linear actuator 30.

In order to apply the concepts described above, in conjunction with FIGS. 1-3, to a marine vessel steering system, it is beneficial if the components of the steering mechanism can be packaged in a way that results in an efficient use of space. This allows the system to be incorporated in an actuation device connected between a transom of the marine vessel and a steering arm of the marine propulsion device.

Figure 4:
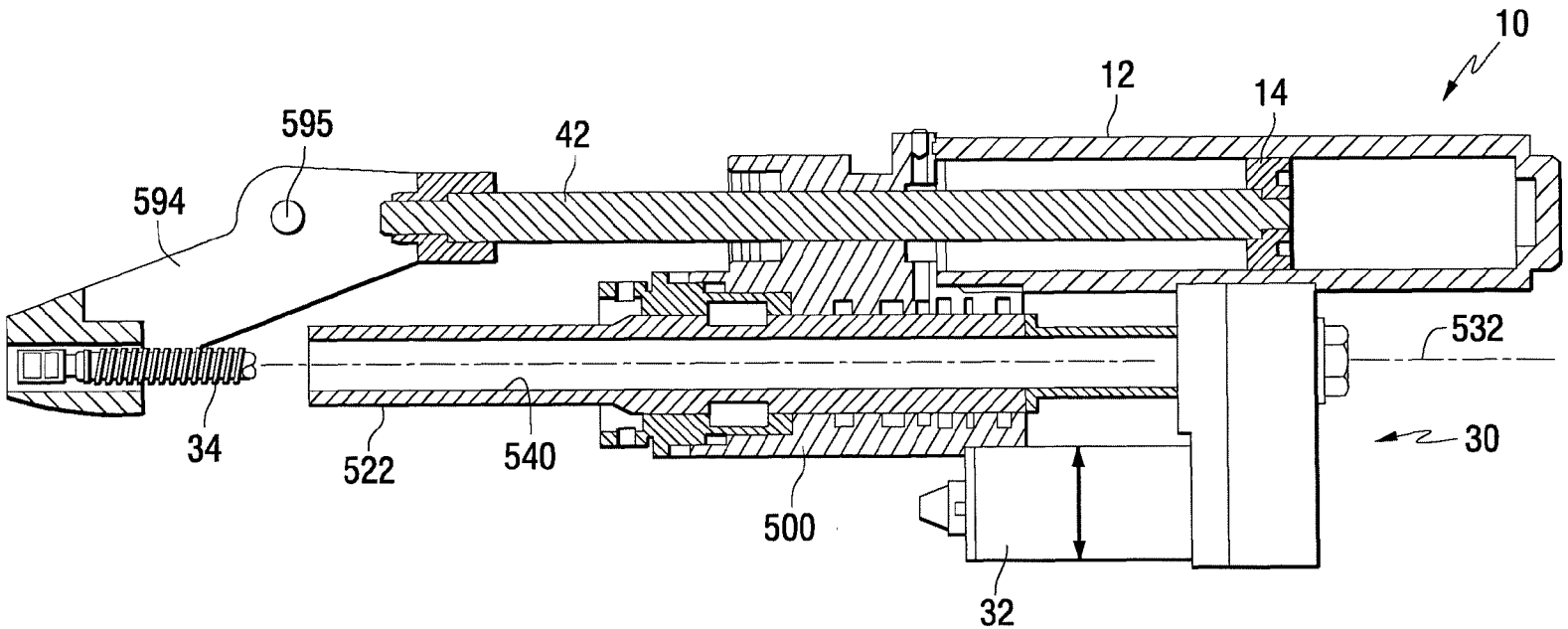
FIG. 4 is a sectional view of a steering mechanism made in accordance with a preferred embodiment of the present invention.
Figure 5:
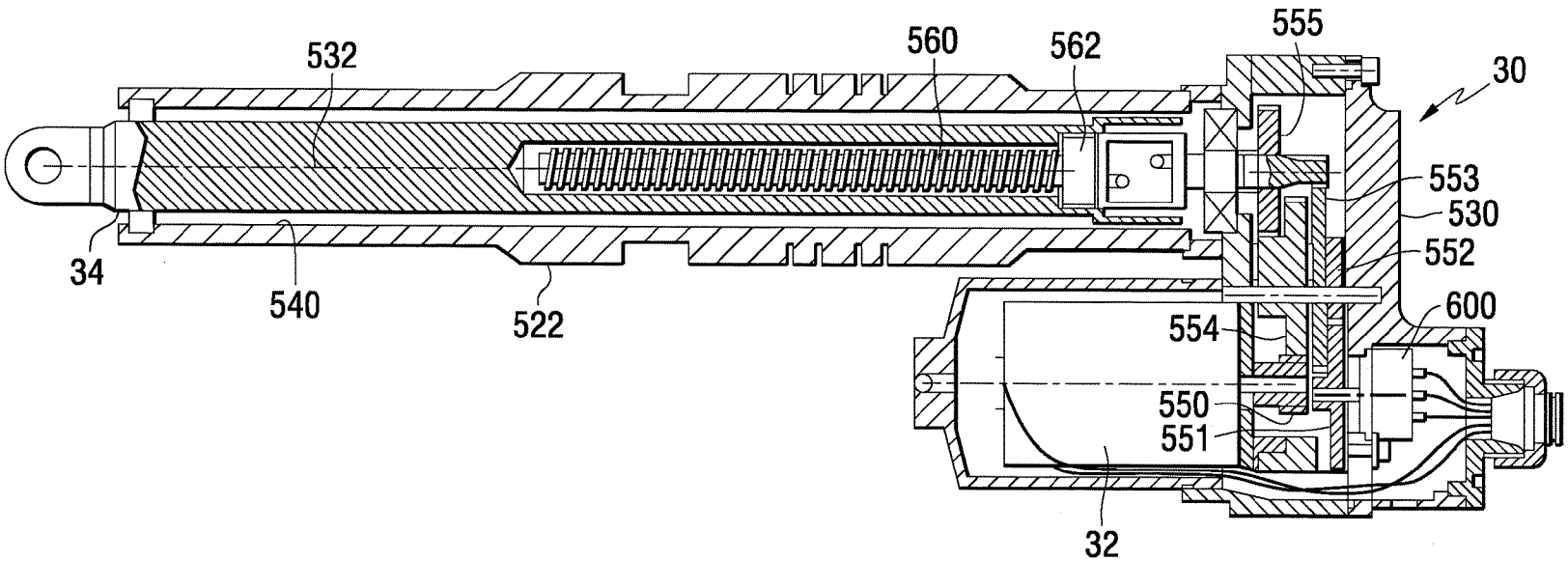
FIG. 5 is a section view of a linear actuator that is used in a preferred embodiment of the present invention.

With reference to FIGS. 4 and 5, a steering mechanism made in accordance with a preferred embodiment of the present invention comprises a spool valve housing 500 and a spool 522 that is slidably supported within the spool valve housing 500. The steering cylinder 10, which is discussed above, is attached to the spool valve housing 500. The steering cylinder 10 comprises a hydraulic cylinder 12 and a piston rod 42 which extends from the hydraulic cylinder. The actuator 30 has a housing 530 and a shaft 34 which is described above in conjunction with the schematic representations in FIGS. 1-3. The actuator 30 is configured to selectively extend and retract the shaft 34 relative to the housing 530 in directions parallel to a central axis 532 of the shaft 34. A preferred embodiment of the present invention also comprises a connector 594. The steering cylinder 12, the actuator 30, the connector 594, and the spool valve housing 500 are connected together in a manner which causes the connector 594 and the spool valve housing 500 to move away from each other in synchrony with the piston rod 42 being extended from the hydraulic cylinder 12 and the shaft 34 being extended from the housing 530 of the actuator 30. In addition, this relationship causes the connector 594 and the spool valve housing 500 to move toward each other in synchrony with the piston rod 42 being retracted into the hydraulic cylinder 12 and the shaft 34 being retracted into the housing of the actuator 30. For purposes of this discussion, it should be understood that the spool 522 is attached to the actuator 30 and, as such, is considered herein to be a portion of the actuator housing 530.

With continued reference to FIGS. 4 and 5, in a preferred embodiment of the present invention, the shaft 34 and the piston rod 42 are both attached to the connector 594. The housing 530, as described above, is attached to the spool 522. The hydraulic cylinder 12 is attached to the spool valve housing 500. In a particularly preferred embodiment of the present invention, the shaft 34 extends through a central cylindrical cavity 540 of the spool 522.

In a particularly preferred embodiment of the present invention, the actuator 30 is a linear actuator. It comprises an electric motor 32 and a gear set. The gear set comprises gears 550-555 which are shown in FIG. 5. These gears are arranged, in the particular embodiment shown in FIG. 5, to determine a particular speed ratio between the rotational speed of the motor 32 and the rotational speed of the shaft 34. In addition, a threaded relationship exists between the threads of a threaded shaft 560 and associated threads of a fixed threaded member 562. Relative rotation between these two components causes the shaft 34 to extend away from or toward the housing 530 of the actuator 30 and relative to the spool 522.

With continued reference to FIGS. 4 and 5, it can be seen that the positions of the various components of the actuator in a preferred embodiment of the present invention provides an efficient package which allows the mechanism to be located in a confined space with regard to other components in a marine vessel. Of particular advantage to this packaging arrangement is the extension of the shaft 34 through the cylindrical cavity 540 of the spool 522. This is accomplished by using a cylindrical housing that serves the dual purposes of containing the shaft 34 and, with its outer cylindrical surface, providing the ports of a spool 522 which interacts with associated ports of the spool valve housing 500. The spool 522 moves axially, in a direction parallel to axis 532, with the actuator 30 and the hydraulic cylinder 12. Similarly, the piston rod 42 moves axially, in a direction parallel to axis 532, in synchrony with the shaft 34 of the actuator 30.

With continued reference to FIGS. 1-5, it should be understood that the connector 594 is connectable to a steering arm 60 of a marine propulsion device such as those identified by reference numerals 121 and 122 in FIG. 3. In addition, the spool valve housing 500 is connectable to a transom 130 of a marine vessel. The hull 595 facilitates the connection to the steering arm 60. The spool valve housing 500 is connected to the transom 130 through the use of a similarly functioning hole which is not shown in the figures. As a result, when the connector 594 moves relative to the spool valve housing 500, in a preferred embodiment of the present invention, the steering arm 60 moves relative to the transom 130.

The packaging of the mechanism described above allows it to be contained within a minimum space proximate both the transom 130 and the steering arm 160. In FIG. 5, electrical connections to a potentiometer 600 are illustrated. These allow the motor 32 to be controlled electrically without the need for push-pull cables as are generally used in marine steering systems known to those skilled in the art. This type of steer-by-wire system is significantly facilitated by the provision of a steering mechanism such as that shown in FIG. 4 which can be located conveniently because of the efficient arrangement and inner connection of its individual components.

With continued reference to FIGS. 1-5, the spool 522 is rigidly attached to the actuator 30 in a preferred embodiment of the present invention. Similarly, the spool valve housing 500 is rigidly attached to the hydraulic cylinder 12. The connector 594 is connected to both the piston rod 42 and the shaft 34 of the actuator 30. The spool is movable relative to the spool valve housing 500.

Although the present invention has been described with particular specificity and illustrated to show a preferred embodiment, it should be understood that alternative embodiments are also within its scope.

We claim:

1. A steering mechanism, comprising:

a spool valve housing;

a spool supported in sliding relation within said spool valve housing;

a steering cylinder attached to said spool valve housing, said steering cylinder comprising a hydraulic cylinder and a piston rod extending from said hydraulic cylinder;

an actuator having a housing and a shaft, said actuator being configured to selectively extend and retract said shaft relative to said housing in directions parallel to a central axis of said shaft; and a connector, said steering cylinder, said actuator, said connector and said spool valve housing being connected together in a manner which causes said connector and said spool valve housing to move away from each other in synchrony with said piston rod being extended from said hydraulic cylinder and said shaft being extended from said housing of said actuator and which causes said connector and said spool valve housing to move toward each other in synchrony with said piston rod being retracted into said hydraulic cylinder and said shaft being retracted into said housing of said actuator.

2. The mechanism of claim 1, wherein:

said shaft and said piston rod are attached to said connector.

3. The mechanism of claim 1, wherein:

said housing is attached to said spool.

4. The mechanism of claim 1, wherein:

said hydraulic cylinder is attached to said spool valve housing.

5. The mechanism of claim 1, wherein:

said shaft extends through a central cylindrical cavity of said spool.

6. The mechanism of claim 1, wherein:

said actuator is a linear actuator.

7. The mechanism of claim 6, wherein:

said linear actuator comprises an electric motor and a gear set, said shaft being attached to a gear of said gear set.

8. The mechanism of claim 1, wherein:

said connector is connectable to a steering arm of a marine propulsion is device.

9. The mechanism of claim 1, wherein:

said spool valve housing is connectable to a transom of a marine vessel.

10. A steering mechanism, comprising:

a spool valve housing;

a spool supported in sliding relation within said spool valve housing;

a steering cylinder attached to said spool valve housing, said steering cylinder comprising a hydraulic cylinder and a piston rod extending from said hydraulic cylinder;

an actuator having a housing and a shaft, said actuator being configured to selectively extend and retract said shaft relative to said housing in directions parallel to a central axis of said shaft, said actuator being a linear actuator which comprises an electric motor and a gear set, said shaft being attached to a gear of said gear set; and a connector, said steering cylinder, said actuator, said connector and said spool valve housing being connected together in a manner which causes said connector and said spool valve housing to move away from each other in synchrony with said piston rod being extended from said hydraulic cylinder and said shaft being extended from said housing of said actuator and which causes said connector and said spool valve housing to move toward each other in synchrony with said piston rod being retracted into said hydraulic cylinder and said shaft being retracted into said housing of said actuator.

11. The mechanism of claim 10, wherein:

said shaft and said piston rod are attached to said connector.

12. The mechanism of claim 11, wherein:

said housing is attached to said spool.

13. The mechanism of claim 12, wherein:

said hydraulic cylinder is attached in sliding relation with said spool valve housing.

14. The mechanism of claim 13, wherein:

said shaft extends through a central cylindrical cavity of said spool.

15. The mechanism of claim 10, wherein:

said connector is connectable to a steering arm of a marine propulsion device.

16. The mechanism of claim 10, wherein:

said spool valve housing is connectable to a transom of a marine vessel.

17. A steering mechanism, comprising:

a spool valve housing;

a spool supported in sliding relation within said spool valve housing;

a steering cylinder attached to said spool valve housing, said steering cylinder comprising a hydraulic cylinder and a piston rod extending from said hydraulic cylinder;

an actuator having a housing and a shaft, said actuator being configured to selectively extend and retract said shaft relative to said housing in directions is parallel to a central axis of said shaft; and a connector, said steering cylinder, said actuator, said connector and said spool valve housing being connected together in a manner which causes said connector and said spool valve housing to move away from each other in synchrony with said piston rod being extended from said hydraulic cylinder and said shaft being extended from said housing of said actuator and which causes said connector and said spool valve housing to move toward each other in synchrony with said piston rod being retracted into said hydraulic cylinder and said shaft being retracted into said housing of said actuator, said shaft and said piston rod being attached to said connector, said housing being attached to said spool, said hydraulic cylinder being attached to said spool valve housing.

18. The mechanism of claim 17, wherein:

said shaft extends through a central cylindrical cavity of said spool.

19. The mechanism of claim 18, wherein:

said actuator is a linear actuator which comprises an electric motor and a gear set, said shaft being attached to a gear of said gear set.

20. The mechanism of claim 19, wherein:

said connector is connected to a steering arm of a marine propulsion device and said spool valve housing is connected to a transom of a marine vessel.

* * * * *